US005379945A

United States Patent [19]

Kataoka

[11] Patent Number: 5,379,945

[45] Date of Patent: Jan. 10, 1995

[54] SHEETS OF CORRUGATED PAPER FOR PRODUCING PACKAGES

[75] Inventor: Hachiro Kataoka, Nagoya, Japan

[73] Assignee: Chuoh Pack Industry Co., Ltd., Aichi, Japan

[21] Appl. No.: 871,688

[22] Filed: Apr. 21, 1992

[30] Foreign Application Priority Data

| | | | |
|---|---|---|---|
| Jun. 19, 1991 | [JP] | Japan | 3-176214 |
| Sep. 2, 1991 | [JP] | Japan | 3-078770[U] |
| Oct. 9, 1991 | [JP] | Japan | 3-290675 |
| Oct. 18, 1991 | [JP] | Japan | 3-299947 |
| Oct. 22, 1991 | [JP] | Japan | 3-304124 |

[51] Int. Cl.[6] ..... B65D 25/04

[52] U.S. Cl. ..... 229/120.26; 229/120.37; 229/120.38

[58] Field of Search ..... 229/120.14, 120.15, 229/120.18, 120.24, 120.25, 120.26, 120.27, 120.36, 120.37, 120.38; 206/561, 521.1, 521.3, 521.4; 217/31

[56] References Cited

U.S. PATENT DOCUMENTS

| | | | |
|---|---|---|---|
| 1,202,985 | 10/1916 | Fogg | 229/120.24 |
| 1,733,663 | 10/1929 | Hale | 206/521.3 |
| 1,931,364 | 10/1933 | Sugerman | 206/521.4 X |
| 3,131,850 | 5/1964 | Redpath | 229/120.26 |
| 3,325,078 | 6/1967 | Bach | 217/31 X |
| 3,927,823 | 12/1975 | Persson | 229/186 X |
| 4,065,021 | 12/1977 | Kedzierski | 229/120.25 X |
| 4,746,053 | 5/1988 | Nichols | 229/120.36 |
| 5,058,802 | 10/1991 | Rutledge | 229/120.26 |

FOREIGN PATENT DOCUMENTS

| | | | |
|---|---|---|---|
| 1538508 | 9/1968 | France | 229/120.26 |

*Primary Examiner*—Allan N. Shoap
*Assistant Examiner*—Christopher McDonald

[57] ABSTRACT

A flat sheet or sheets of corrugated paper for producing a package are provided. The sheet is provided with creases from which to fold the sheet into a package. A first embodiment of the invention is a pair of such sheets foldable into a checker-patterned package with a relatively large number of compartments to accommodate commodities. A second embodiment is such a sheet foldable into a package with four compartments. A third embodiment is such a sheet foldable into a package with two compartments. A fourth embodiment is such a sheet foldable into a package with two compartments which is initially entirely closed, but can be opened by breaking the top. A fifth embodiment is such sheets foldable into a package which can be used either independently or in a pair.

2 Claims, 14 Drawing Sheets

SHEETS OF CORRUGATED PAPER FOR PRODUCING PACKAGES

FIELD OF THE INVENTION

This invention relates to sheets of corrugated paper for producing packages.

BACKGROUND OF THE INVENTION

Various packages formed of corrugated paper are known. However, such packages of prior art, especially one constructed of separate elements, namely, a partition element and a support element to accommodate the partition element, are not easy to produce. So it is desired that such packages be produced easily. Also, there is known packings of Styrofoam supporting the ends of a product, such as a cartridge for a copy machine, in a cardboard box. The packings act as a cushion to protect the product against damage if the product is given a shock in transportation or handling. Styrofoam, however, is derived from petroleum resources, which are limited. In addition, Styrofoam is relatively awkward when it is disposed as rubbish. So it is desired that such packings be produced from a different material free from the problem and drawback of Styrofoam.

SUMMARY OF THE INVENTION

It is an object of the invention to provide a material for producing a package of corrugated paper more easily than heretofore.

Another object of the invention is to provide flat sheets of corrugated paper for producing packages.

Still another object of the invention is to provide a flat sheet of corrugated paper for producing a package which can be used either independently or in a pair. When it is used in a pair, it acts as a packing to cushion the contents in a larger package such as a cardboard.

According to the invention, a flat sheet or sheets of corrugated paper for producing a package are provided. The sheet is provided with creases from which to fold the sheet into a package. A first embodiment of the invention is a pair of such sheets foldable into a checker-patterned package with a relatively large number of compartments to accommodate commodities. A second embodiment is such a sheet foldable into a package with four compartments. A third embodiment is such a sheet foldable into a package with two compartments. A fourth embodiment is such a sheet foldable into a package with two compartments which is initially entirely closed, but can be opened by breaking the top. A fifth embodiment is such sheets foldable into a package which can be used either independently or in a pair.

BRIEF DESCRIPTION OF THE DRAWING

FIG. 1 is a plan view of a first flat sheet 101A of corrugated paper;

FIG. 2 is a plan view of a second flat sheet 101B of corrugated paper;

FIGS. 3 and 4 show how to fold the first sheet 101A of FIG. 1;

FIG. 5 shows how to fold the second sheet 101B of FIG. 2;

FIG. 6 is a perspective view of a checker-patterned package assembled from the first and second sheets 101A and 101B;

FIG. 7 is a plan view of a flat sheet 102 of corrugated paper;

FIGS. 8, 9, and 10 show how to fold the sheet 102 of FIG. 7;

FIG. 11 is a perspective view of a package 202 produced by folding the sheet 102.

FIG. 12 illustrates one example of use of the package 202;

FIG. 13 is a plan view of a flat sheet 103 of corrugated paper;

FIG. 14 shows how to fold the sheet 103 of FIG. 13;

FIG. 15 is a perspective view of a package 203 produced by folding the sheet 103;

FIG. 16 is a plan view of a flat sheet 104 of corrugated paper;

FIGS. 17 and 18 show how to fold the sheet 104 of FIG. 16;

FIGS. 19 and 20 illustrate a package 204 produced by folding the sheet 104;

FIG. 21 is a plan view of a flat sheet 105 of corrugated paper;

FIG. 22 is a plan view of an auxiliary sheet 106 of corrugated paper;

FIGS. 23, 24, and 25 show how to fold the sheet 105 and how to join the auxiliary sheet 106 with the sheet 105;

FIG. 26 is a perspective view of a package 205 produced by folding the sheet 105 and joining the auxiliary sheet 106 with the sheet 105;

In FIG. 27 two packages 205 are used in a larger package 600 to support the ends of a product 500, such as a cartridge for a copy machine, to protect the product against damage if the product is given a shock during transportation or the like; and FIG. 28 shows one package 205 used in a larger package 600.

DETAILED DESCRIPTION OF PREFERRED EMBODIMENTS

First embodiment

A package which embodies the invention in one preferred form will now be described with reference to FIGS. 1 to 6.

Figure 6:
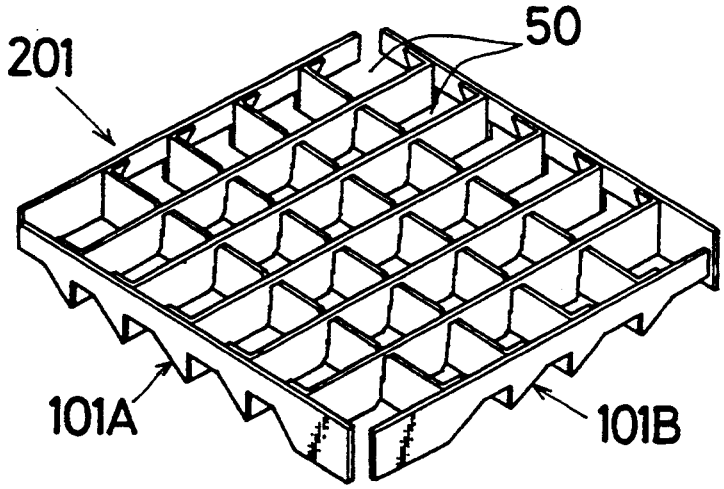

FIG. 6 depicts a checker-patterned package 201 of the invention. As illustrated, the package 201 has plural compartments 50 to accommodate commodities. As described below, the package 201 is constructed by folding a first flat sheet 101A of FIG. 1 and a second flat sheet 101B of FIG. 2 and joining the two sheets. The sheets are of corrugated paper.

Figure 1:
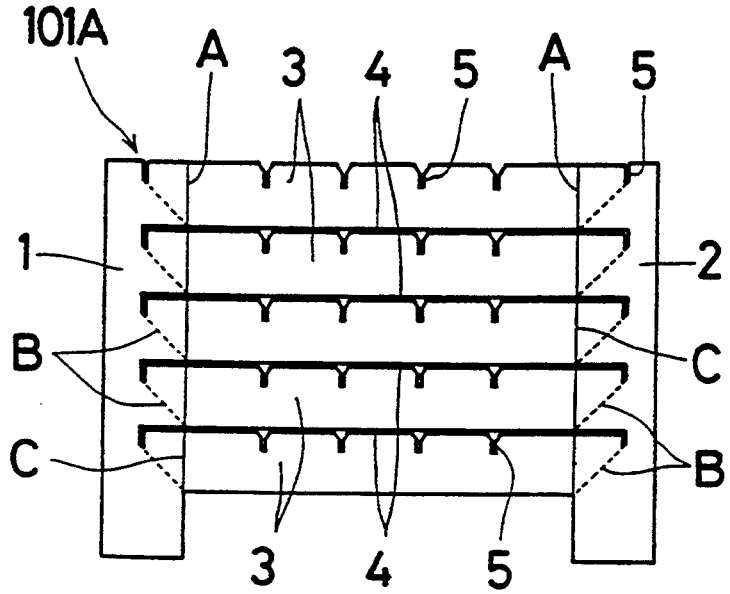
FIGS. 1 to 6 show a first embodiment of the invention.
Figure 4:
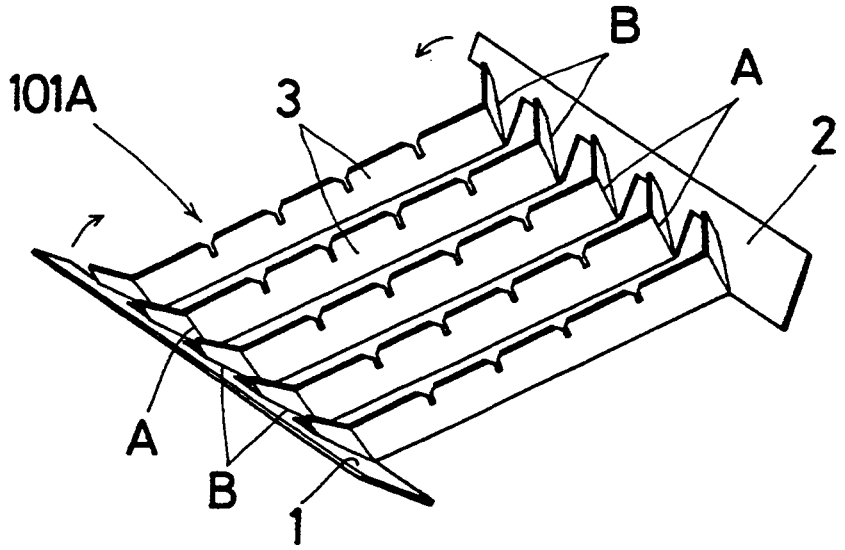

Referring to FIG. 1, the first sheet 101A has opposed side wall members 1 and 2. Between the side wall members 1 and 2 extend partition wall members 3. The partition wall members 3 are separated from each other by narrow openings 4 extending parallel with the partition wall members 3. Slits 5 are formed in an edge of each partition wall member 3 which forms the top of the partition wall member 3 when the partition wall member 3 is stood (FIG. 4). The outermost slits 5 defines outermost ends of the partition wall member 3. A crease A is formed along the side wall member 1, and another crease A is formed along the side wall member 2. Each crease A does not extend continuously, but is broken into segments C by the narrow openings 4. An inclined crease B is formed from the bottom of each outermost slit 5 to one end of one of the segments C. The inclined crease B makes an angle of 45 degrees with the crease A. In the under surface of the sheet 101A, small, shallow openings are provided along each inclined crease B to facilitate the standing of the partition wall member 3.

Figure 2:
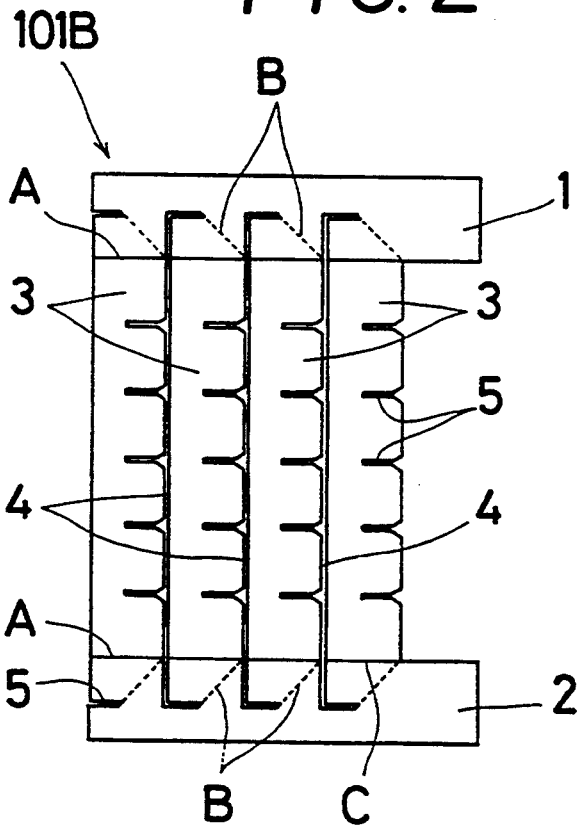
Figure 5:
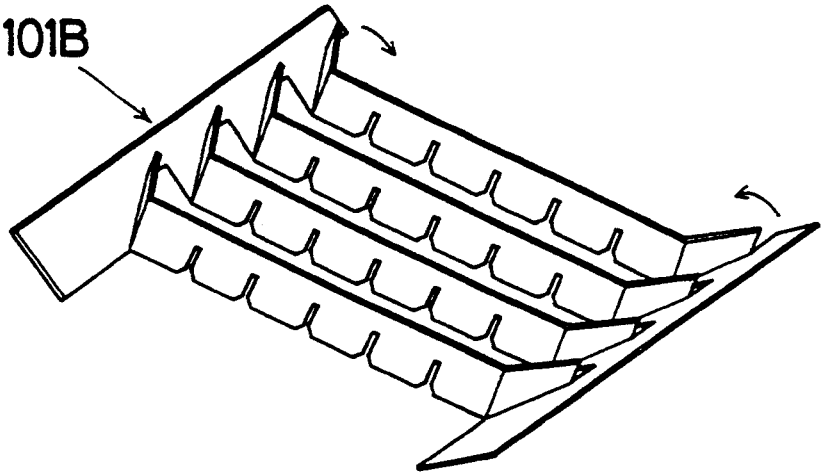

Referring to FIG. 2 in which slits corresponding to the slits 5 are designated by reference numeral 6, the second sheet 101B has essentially the same construction as the first sheet 101A, except that in the second sheet 101B the middle slits 6, i.e., the slits 6 other than the outermost slits 6, are provided in an edge of the partition wall member 3 which forms the bottom of the partition wall member 3 when the partition wall member 3 is stood (FIG. 5).

Figure 3:
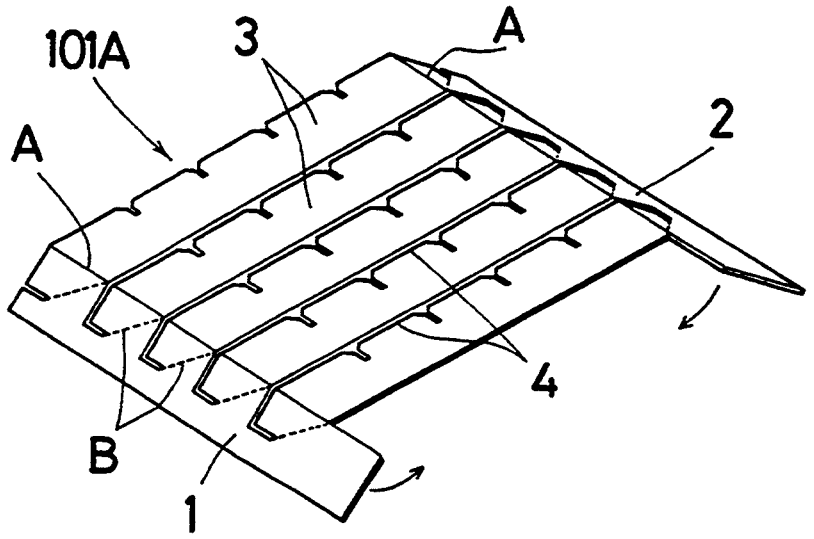

To assemble the first and second sheets 101A and 101B into a package of FIG. 6, first, the side wall members 1 and 2 of the first sheet 101A are turned down for a certain angle from the creases A, as indicated by arrows of FIG. 3. It facilitates the standing of the partition wall members 3. Then, as shown in FIG. 4, the side wall members 1 and 2 are folded upward from the creases B until the side wall members 1 and 2 come to upright positions. It causes the partition wall members 3 to stand simultaneously with the side wall members 1 and 2. The portions of each side wall member 3 located outside the creases A come into contact with the respective side wall members 1 and 2. Then, the second sheet 101B is also folded in the same manner as the first sheet 101A. Then, the second sheet 101B is joined with the first sheet 101A such that the middle slits 6 of the second sheet 101B mate with the middle slits 5 of the first sheet 101A. A checker-patterned package 201 of FIG. 6 is thus assembled.

The package 201 has no bottom. In use, therefore, the package 201 must be put into, for example, a cardboard box. Then, for example, a product such as a small machine part can be put in each compartment 50.

In the illustrated embodiment, since the slits 6 of the second sheet 101B are deeper than the slits 5 of the first sheet 101A, the second sheet 101B is stably joined with the first sheet 101A.

In the illustrated embodiment, the partition wall members 3 of the first sheet 101A are five in number, while the partition wall members 3 of the second sheet 101B are four in number. It will be appreciated, however, that a desired number of partition wall members 3 may be provided depending upon the number of compartments 50 which one desires to produce.

Second embodiment

Figure 10:
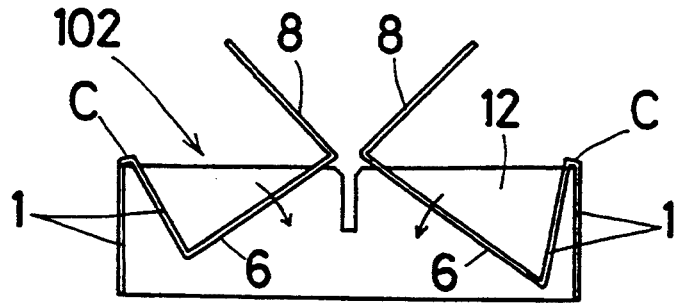
Figure 11:
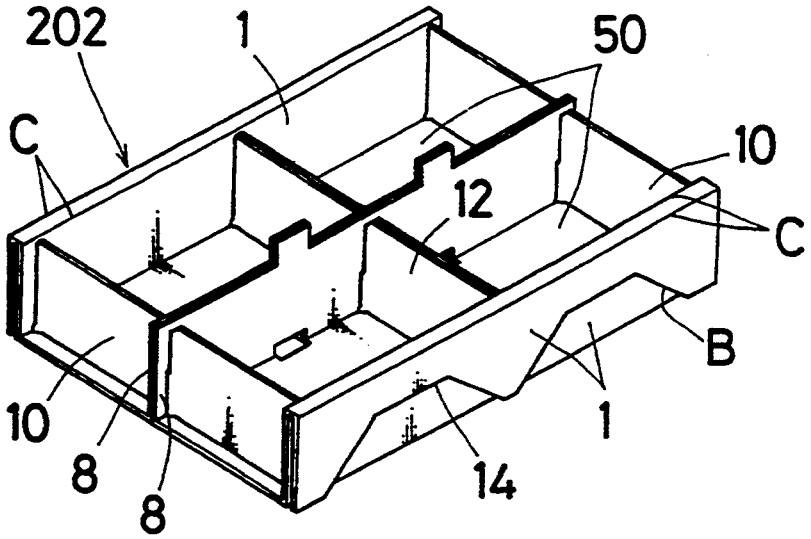

FIG. 11 depicts a second package 202 of the invention. The package 202 of FIG. 11 is formed by folding a flat sheet 102 of corrugated paper of FIG. 7 as shown in FIGS. 8, 9, and 10.

Figure 7:
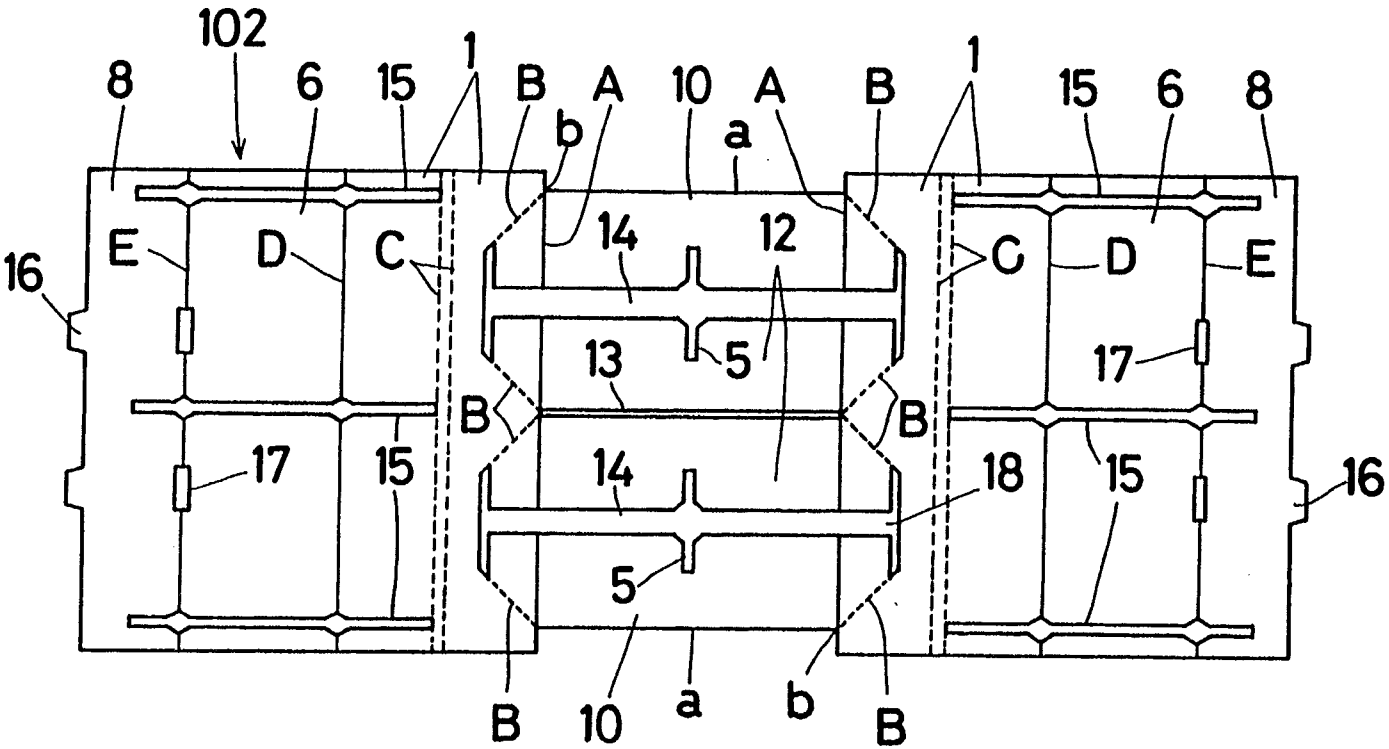
FIGS. 7 to 12 show a second embodiment of the invention.

Referring to FIG. 7, at its center the sheet 102 includes first partition wall members 12 and first side wall members 10. Between the first partition wall members 12 are provided a central, narrow opening 13. One first partition wall member 12 and one first side wall member 10 are separated from each other by a wide opening 14. The other first partition wall member 12 and the other first side wall member 10 are also separated from each other by another wide opening 14. Each wide opening 14 terminates in side openings 18 making right angles with the wide opening 14. A slit 5 crosses one of the wide openings 14, and another slit 5 crosses the other wide opening 14. Two creases A are formed transversely between corners b. As clearly shown, each crease A does not extend continuously, but is broken into segments by the wide opening 14.

One side of the sheet 102 will now be described. However, since the sheet 102 has a symmetrical shape as clearly shown in FIG. 7, the description of one side applies to the other side. An inclined crease B is formed from one corner of one first side wall member 10 to one end of one side opening 18. Another inclined crease B is formed from the opposed end of the one side opening 18 to one corner of one first partition wall member 12. Similarly, other two inclined creases B are also formed in conjunction with the other first partition wall member 12 and the other first side wall member 10. Each inclined crease B makes an angle of 45 degrees with the crease A. Reference numeral 1 designates a second side wall member. The two side openings 18 and the four inclined creases B form a principal borderline between the central members (12 and 10) and the second side wall member 1. At its center the second side wall member 1 includes a transverse crease C. On the outside of the second side wall member 1 is located a bottom member 6. A transverse crease D forms a borderline between the second side wall member 1 and the bottom member 6. On the outside of the bottom member 6 is located a second partition wall member 8. A transverse crease E forms a borderline between the bottom member 6 and the second partition wall member 8. Two openings 17 are provided in the crease E. The second partition wall member 8 has two projections 16. Three elongate openings 15 extend parallel with each other from the crease C to the middle of the second partition wall member 8.

Figure 8:
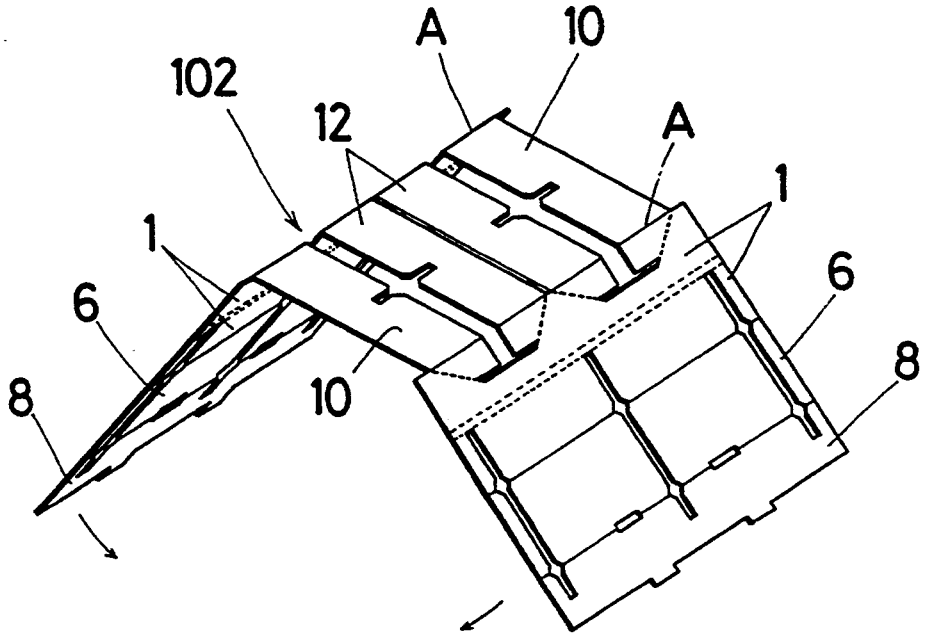
Figure 9:
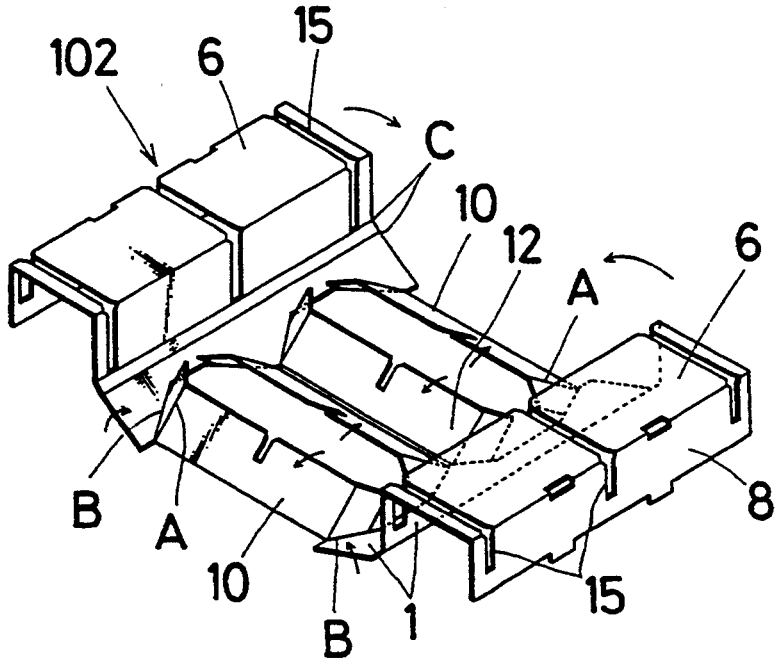

Referring to FIGS. 8, 9, and 10, it will now be described how to fold the sheet 102 of FIG. 7 into a package 202 of FIG. 11. First, as shown in FIG. 8, the sheet 102 is folded downward for a certain degree from the creases A. It facilitates the standing of the first partition wall members 12 and of the first side wall members 10. Then, as shown in FIG. 9, the second side wall members 1 are folded upward from the creases B. It causes both the first partition wall members 12 and the first side wall members 10 to stand from the creases B at the same time as the second side wall members 1. As a result, the first partition wall members 12 substantially come into contact with each other, and thus constitute a first partition wall to provide two separate inner spaces. Then, each second side wall member 1 is folded inward from the crease C for a certain angle. Then, each bottom member 6 is folded outward from the crease D for an angle of 90°. Then, each second partition wall member 8 is folded downward from the crease E for an angle of 90°. Then, as shown in FIG. 10, each second side wall member 1 is folded inward in two from the crease C to enclose therein the portions of the first partition wall members 12 and of the first side wall members surrounded by the inclined creases B, the wide openings 14, and the creases A. As a result, the outer ones of the three elongate openings 15 mate with the first side wall members 10, respectively, and the middle elongate opening 15 mates with the first partition wall. The portions of the outer openings 15 located in the second partition wall member 8 engage with the portions of the respective first side wall members 10 directly below their slits 5, and similarly the portion of the middle opening 15 located in the second partition wall member 8 engages with the portion of the first partition wall directly below its slit 5. Thus, each bottom member 6 comes to a position where it constitutes a half bottom, and at the same time the second partition wall members 8 come into contact with each other to provide a second partition wall crossing the first partition wall. A package 202 of FIG. 11 with four compartments 50 to accommodate commodities is produced in this manner.

Figure 12:
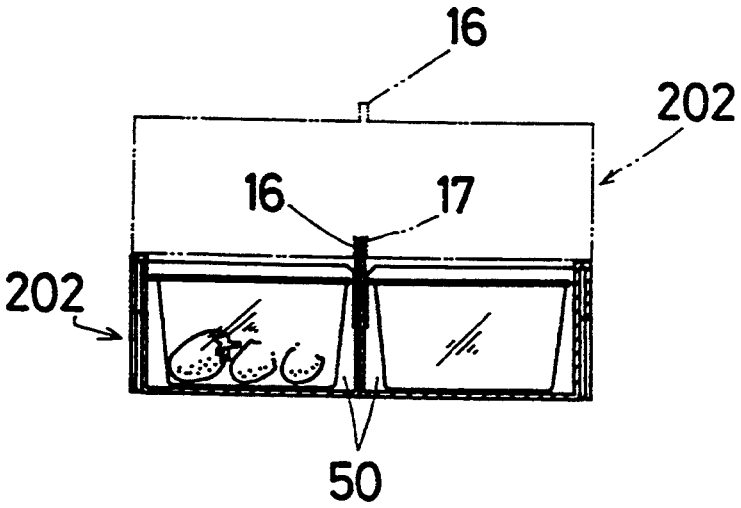

In the package 202, bottom openings 17 are located below the second partition wall (8, 8), and the second partition wall has projections 16. The bottom openings 17, together with the projections 16, make it possible to place packages 202 stably on each other. That is, as shown in FIG. 12, another package 202 can be stably placed on the package 202 by mating the projections 16 of the latter with the bottom openings 17 of the former.

Third embodiment

Figure 14:
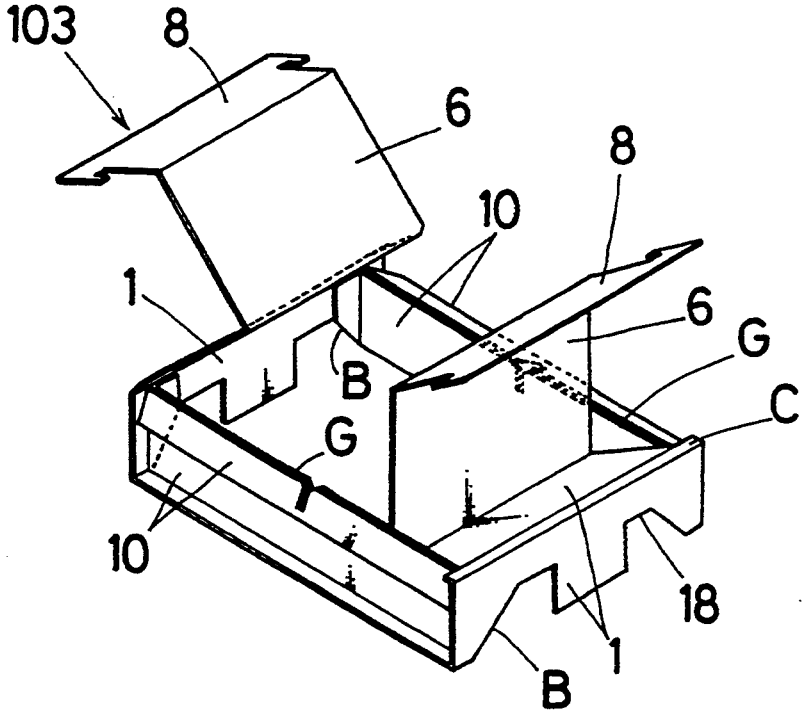
Figure 15:
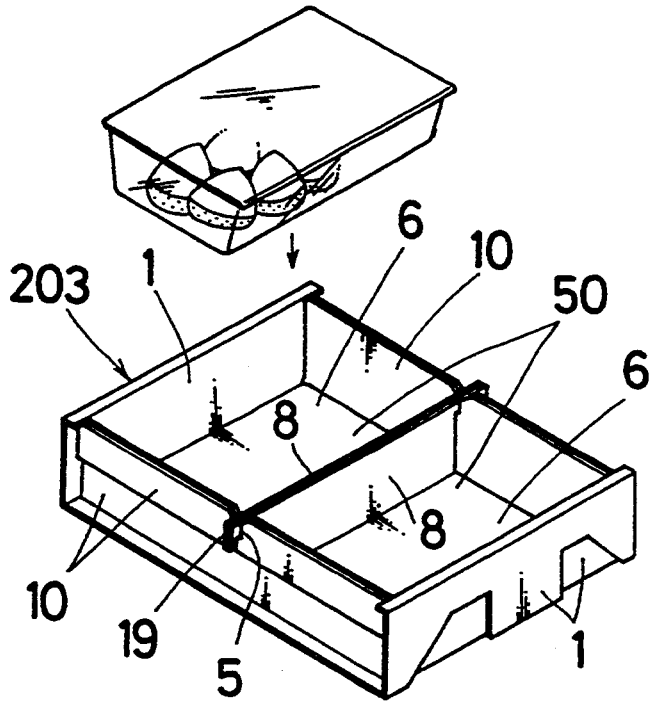

FIG. 15 shows a third package 203 of the invention. The package 203 is formed by folding a flat sheet 103 of corrugated paper of FIG. 13 as shown in FIG. 14.

Figure 13:
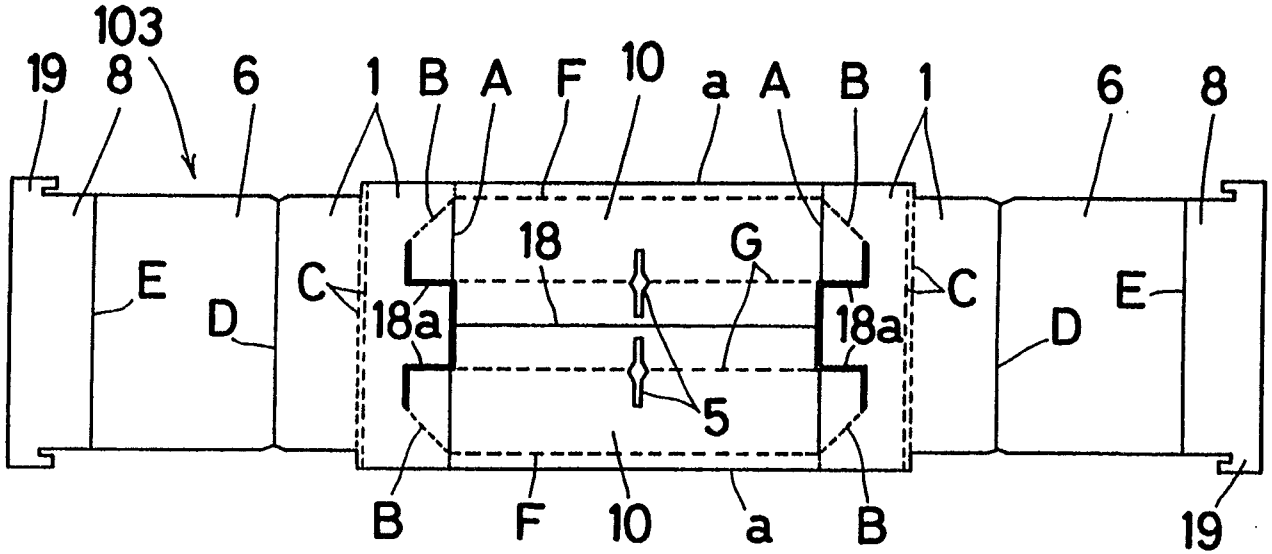
FIGS. 13 to 15 show a third embodiment of the invention.

Referring to FIG. 13, at its center the flat sheet 103 has first side wall members 10. The first side wall members 10 are divided at 18. Each first side wall member has parallel creases F and G extending along the length of the sheet 103. Also, parallel creases A extend transversely from the ends of the crease H to one edge a of the first side wall member 10. Each crease A is in contact with one end of the crease F at one portion thereof. Inclined creases B extend from the respective ends of the crease F. Each inclined crease B terminates in one end of a narrow, angular opening 18*a*. Also, each inclined crease B makes an angle of 45 degrees with the straight crease A. A central opening 5 crosses the crease G.

One side of the sheet 103 will now be described. However, since the sheet 103 has a symmetrical shape as clearly shown in FIG. 13, the description of one side applies to the other side. A second side wall member 1 is located adjacent to the first side wall members 10. The inclined creases B and the angular opening 18*a* chiefly form a borderline between the first side wall members 10 and the second side wall member 1. The second side wall member 1 has a central transverse crease C. A bottom member 6 is located adjacent to the first second side wall member 1. A transverse crease D is formed between the second side wall member 1 and the bottom member 6. A partition wall member 8 is located adjacent to the bottom member 6. A transverse crease E is formed between the bottom member 6 and the partition wall member 8. The partition wall member 8 has opposed hooked portions 19.

To fold the sheet 103 into a package 203 of FIG. 15, first, each second side wall member 1 is folded downward from the crease A for a certain angle. It facilitates the standing of the first side wall members 10. Then, the second side wall member 1 is folded upward from the inclined creases B. It causes the first side wall members 10 to stand from the creases F and B at the same time as the second side wall members 1. Thus, the first side wall members 10 provide a space between them. Then, each first side wall member 10 is folded outward from the crease G. Then, also as shown in FIG. 14, each second side wall member 1 is folded inward in two from the crease C. Then, each bottom member 6 is folded upward from the crease D. Then, also as shown in FIG. 14, each partition wall member 8 is folded outward from the crease E. Then, each bottom member 6 is located in a horizontal plane. As a result, each bottom member 6 forms a half bottom, and at the same time the partition wall members 8 come into contact with each other to form a partition wall. The hooked portions of the partition wall members 8 mate with the openings 5 of the first side wall members 10. A package 203 of FIG. 15 with two compartments 50 to accommodate commodities is constructed in this manner.

Fourth embodiment

Figure 16:
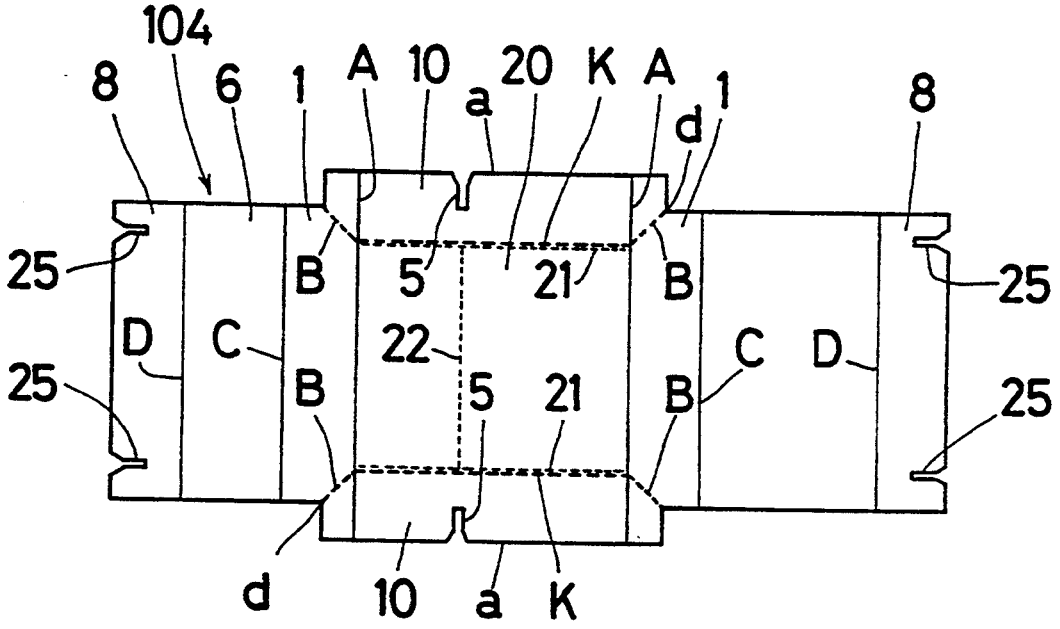
FIGS. 16 to 20 show a fourth embodiment of the invention.
Figure 17:
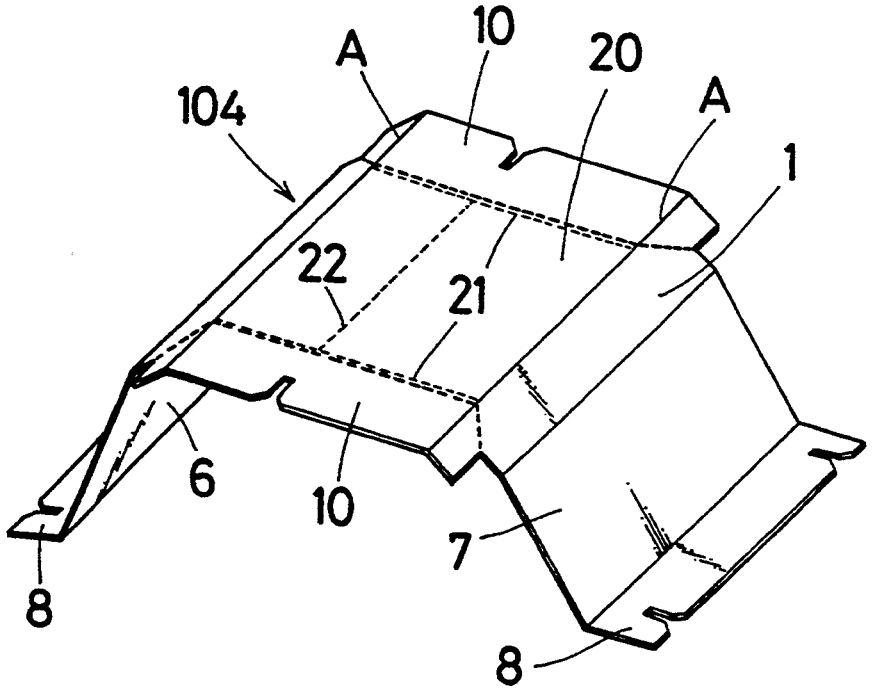
Figure 18:
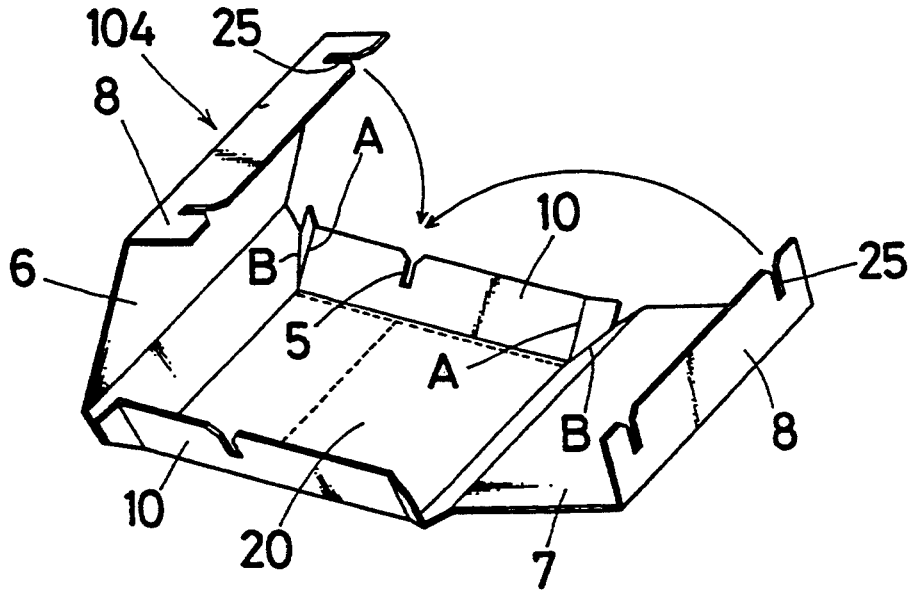
Figure 20:
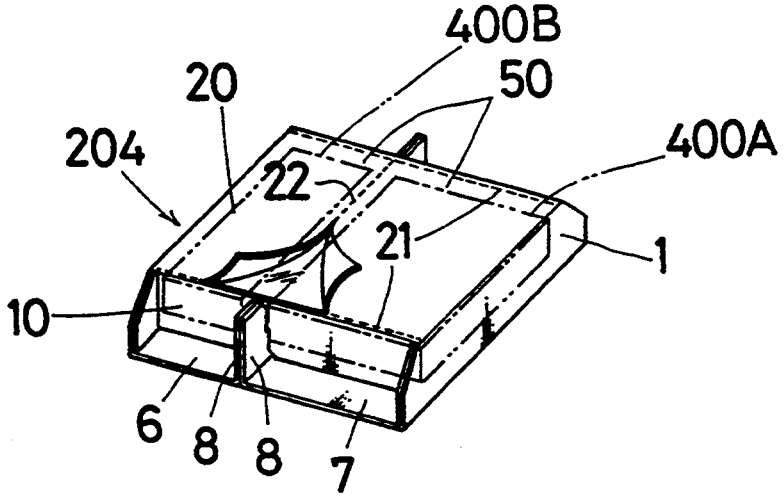

FIG. 20 depicts a fourth package 204 of the invention. The package 204 is formed by folding a flat sheet 104 of corrugated paper of FIG. 16 as shown in FIGS. 17 and 18.

The sheet 104 includes first side wall members 10. Each first side wall member 10 is defined by a lengthwise crease K, two inclined creases B extending from the respective ends of the crease K to corners d, and an outer edge a. Each first side member 10 has a slit 5. A top member 20 is located between the first side wall members 10. In the top member 20, a series of perforations 21 extend along one of the creases K, and another series of perforations 21 extend along the other crease K. Also, a series of perforations 22 extend transversely between the two series of perforations 21. Two creases A extend transversely from the outer edge a of one first side wall member 10 to the outer edge a of the other first side wall member 10. The central portion of each crease A forms one edge of the top member 20. Each inclined crease B makes an angle of 45 degrees with the straight crease A.

The right side of the sheet 104 will now be described. A second side wall member 1 is located adjacent to the top member 20. The second side wall member 1 is defined by the central portion of the crease A, the two inclined creases B, outer edges extending along the length of the sheet 104, and a transverse crease C. A bottom member 7 is located adjacent to the second side wall member 1. The left edge of the bottom member 7 is formed by the crease C, and the right edge thereof is formed by a crease D. A partition wall member 8 is located adjacent to the bottom member 7. The left edge of the partition wall member 8 is formed by the crease D. The partition wall member 8 has two slits 25.

The left side of the sheet 104 has exactly the same construction as its right side, except that the bottom member 6 of the left side is narrower than the bottom member 7 of the right side.

Figure 19:
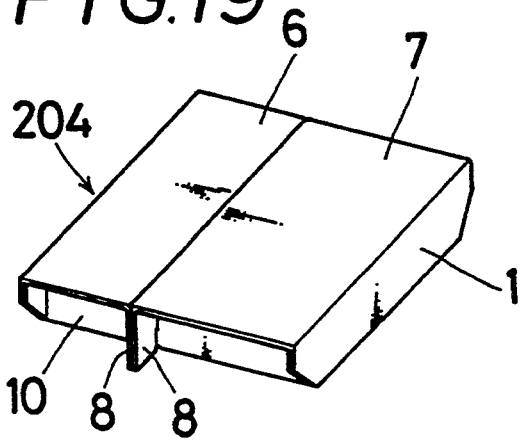

To fold the sheet 104 into a package 204 of FIG. 20, first, each second side wall member 1 is folded downward for a certain degree from the crease A. It facilitates the standing of the first side wall members 10. Then, each second side wall member 1 is folded upward from the crease A. It causes the first side wall members 10 to stand from the creases K at the same time as the second side wall members 1 (FIG. 18). Then, each partition wall member 8 is folded inward from the crease D in advance. Then, smaller packages 400A and 400B containing commodities (FIG. 20) may be placed on the top member 20 on the right and left sides, respectively, of the transverse perforations 22 thereof. Then, each bottom member (6, 7) is folded inward from the crease C for an angle of 90°. As a result, the slits 25 of the partition wall members 8 mate with the slits 5 of the first side wall members 10, and the partition wall members 8 come into contact with each other to form an inner partition wall. There is thus formed a package 204 of FIG. 19 with two inner compartments 50 (FIG. 20) housing the respective smaller packages 400A and 400B. However, in FIG. 19, the bottom of the package 204 formed by the bottom members 6 and 7 is up. So, then, the package 204 is turned upside down as shown in FIG. 20. The contents 400A and 400B can be exposed by breaking the top member 20 along its perforations 21 and 22.

Fifth Embodiment

Figure 24:
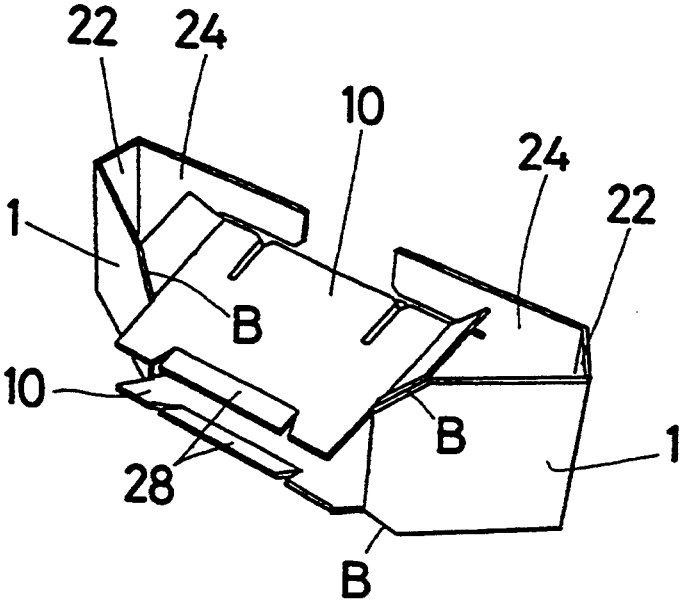
Figure 25:
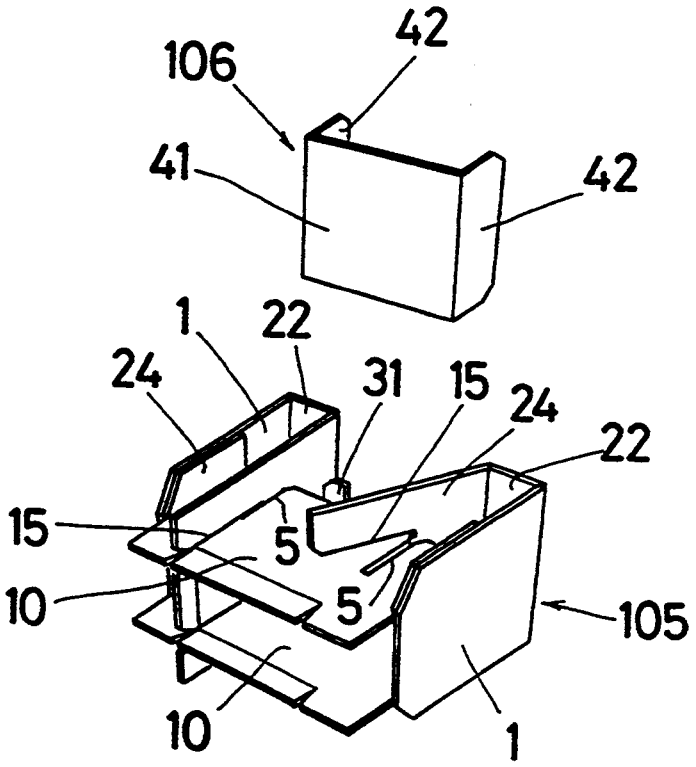
Figure 26:
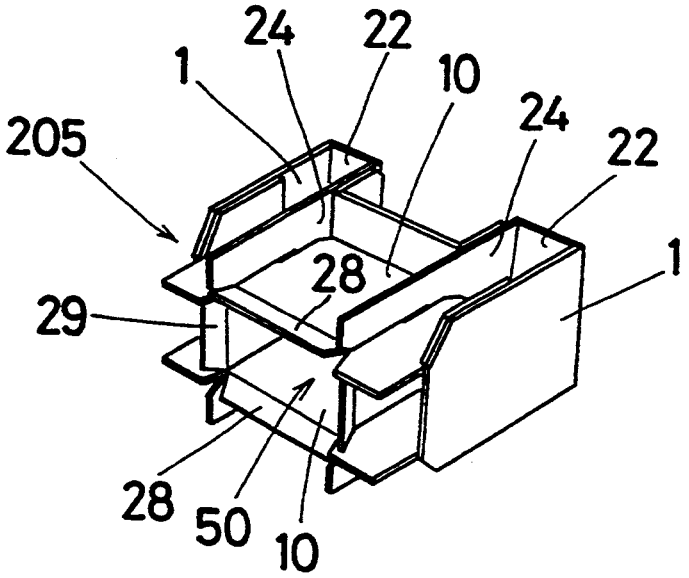

FIG. 26 shows a fifth package 205 of the invention. The package 205 is formed by folding a flat sheet 105 of corrugated paper of FIG. 21 as shown in FIGS. 23, 24, and 25 and connecting an auxiliary sheet 106 of corrugated paper of FIG. 22 to the sheet 105.

Figure 21:
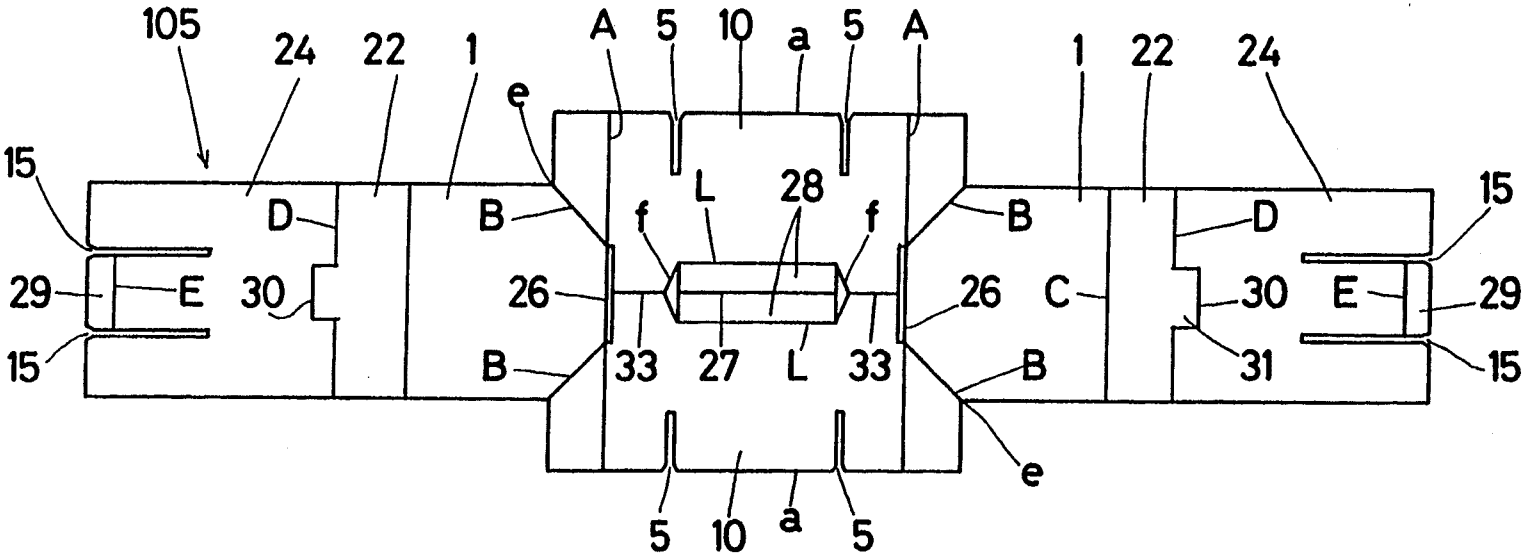
FIGS. 21 to 28 show a fifth embodiment of the invention.

Referring to FIG. 21, at its center the sheet 105 includes two first support members 10. The first support members 10 are divided from each other by a central cut 27 and two side cuts 33. Two edge elements 28 are located on opposed sides of the central cut 27, respectively, and are parallel with the central cut 27. Each edge element 28 has a crease L. A triangular openings f is provided between the edge elements 28 and one side cut 33, and another triangular opening f is provided between the edge elements 28 and the other side cut 33. Each side cut 33 has one end in an narrow opening 26 making right angles with the side cut 33. Each first support member 10 also includes two slits 5 and two creases A. Each crease A is formed from an outer edge a of the first support member 10 to one end of one of the narrow openings 26. In addition, each first support member 10 includes two inclined creases B each extending from a corner e to the inner end of one of the narrow openings 26. The inclined crease B makes an angle of 45 degrees with the straight crease A.

One side of the sheet 105 will now be described. However, as the sheet 105 has a symmetrical shape as clearly shown in FIG. 21, the description of one side of the sheet 105 applies to its other side. A side wall member 1 is located adjacent to the first support members 10. The narrow opening 26 and the inclined creases B form a borderline between the first support members 10 and the side wall member 1. The side wall member 1 has a transverse crease C. On the right side of the crease C is located a back wall member 22. The back wall member 22 has a projection 31 defined by an angular cut 30. The back wall member 22 also has a transverse crease D. On the right side of the back wall member 22 is located a second support member 24. The crease D and the angular cut 30 form a borderline between the back wall member 22 and the second support member 24. The second support member 24 has lengthwise slits 15. Between the slits 15 is provided an edge element 29 which can be folded from a crease E.

Figure 22:
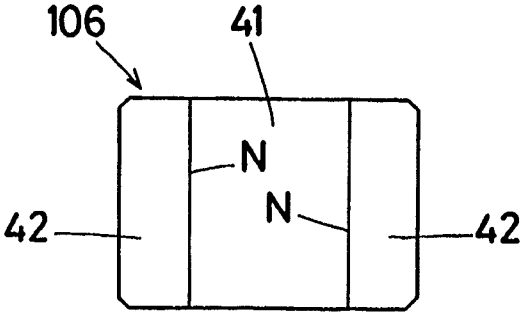
Figure 23:
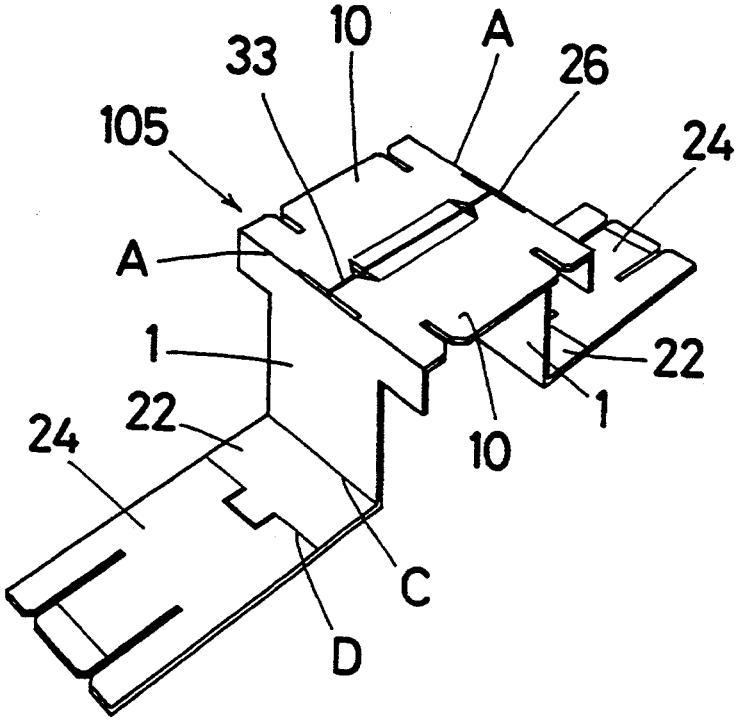

To fold the sheet 105 into a package 205 of FIG. 26, first, the sheet 105 is folded downward from the creases A as shown in FIG. 23, and is folded outward from the creases C. It facilitates the folding of the first support members 10 relative to the side wall members 1. Then, as shown in FIG. 24, the sheet 105 is so turned that one of the first support members 10 comes below the other first support member 10. Then, as shown in FIG. 24, the side wall members 1 are folded forward from the inclined creases B. It causes the portion of each first support member 10 outside the crease A to fold from the crease A (FIG. 24). At the same time, the edge elements 28 of the first support members 10 move away from each other (FIG. 24). Then, each second support member 24 is folded from the crease D (FIG. 24). Then, as shown in FIG. 25, the slits 15 of the second support members 24 are mated with the slits 5 of the first support members 10. As a result, the second support members 24 are joined with the first support members 10 at a right angle. Then, as shown in FIG. 25, an auxiliary sheet 106 of FIG. 22 is folded for an angle of 90 degrees from its creases N, and is disposed in the space between the projections 31 of the back wall members 22. A package 205 of FIG. 26 with an inner space 50 to accommodate a commodity is thus completed.

Figure 28:
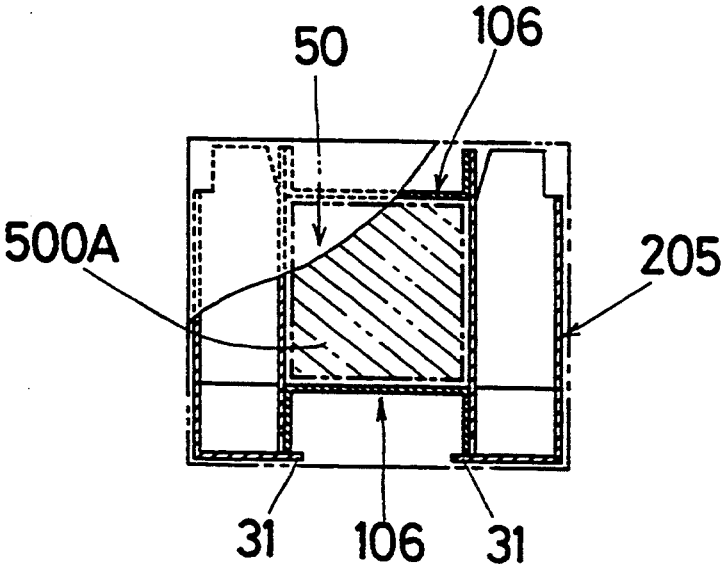

Before putting a commodity in the space 50, it is preferable to fold the edge elements 28 (of the first support members 10) and 29 (of the second support members 24) outward for a certain angle to facilitate the putting of the commodity in the space 50. After the commodity (500A of FIG. 28) has been put in the space 50, another auxiliary sheet 106 (FIG. 28) similar to the back auxiliary sheet 106 can be applied to the front of the package 205 to close the opening 50. Then, the package 205 can be put in a larger package 600 (FIG. 28).

Figure 27:
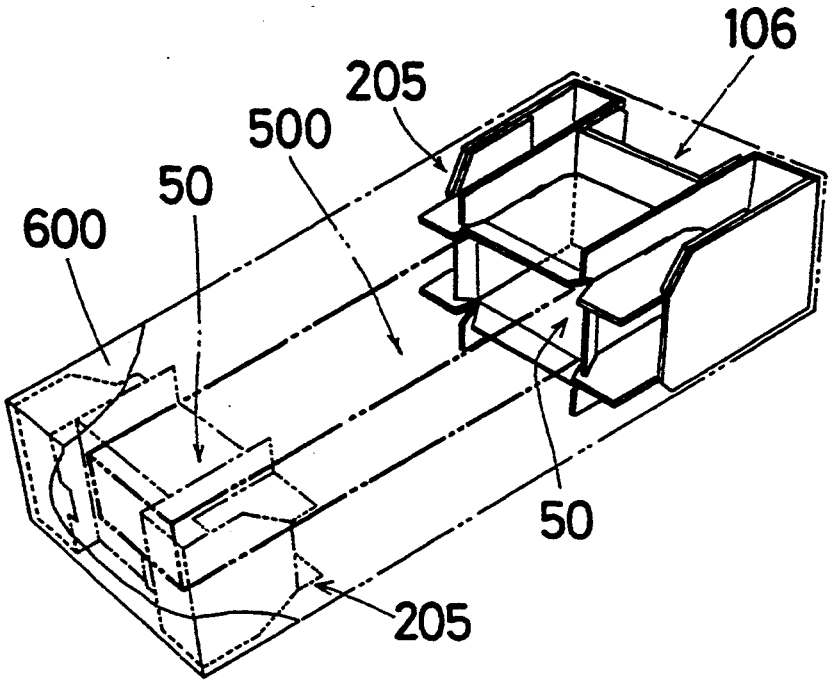

Usually, however, the package 205 of FIG. 26 is used not independently, but in a pair. That is, the package 205 has its principal use in supporting one end of a product, such as a cartridge for a copy machine, in a larger package. In such a use, as shown in FIG. 27, both ends of a product 500 are inserted into the inner spaces 50 of two packages 205 until the ends of the product 500 come into contact with the auxiliary sheets 106. Then, the whole is put in a larger package 600 such as a cardboard box. It will be appreciated that the packages 205 protect the content 500 against damage if it is given a shock during transportation. In the function of cushioning the content, the packages 205 are equal to conventional packings of Styrofoam.

What is claimed is:

1. Sheet material for producing a container, which comprises first and second flat sheets (101A and 101B) that are adapted to be folded and fitted together, each sheet including (i) spaced apart side wall members (1 and 2), (ii) spaced apart partition wall members (3) having top and bottom edges extending between and at right angles to said spaced apart side wall members (1 and 2), said partition wall members being separated from each other by narrow openings (4) extending parallel to said partition wall members, (iii) a plurality of slits (5) provided in each partition wall member (3) and equaling in number the number of the partition wall members (3) of the other sheet (101A or 101B) plus two, the outermost slits in each partition wall member (3) defining the outermost ends of that partition wall member (3), (iv) a first pair of creases (A) formed adjacent the opposite ends of each partition wall member (3), said creases (A) being parallel to said side wall members (1 and 2), and (v) a second pair of creases (B) formed in each partition wall member (3), each such crease (B) being on a 45° angle that extends between the bottom of one of said outermost slits and one end of one of said first pair of creases (A) wherein in the first sheet (101A) all of the slits (5) are formed in the top edge of the partition wall member (3) and in the second sheet (101B) the slits (5), other than said outermost slits, are formed in the bottom edge of the partition wall member 3.

2. A container which includes first and second sheets (101A and 101B) that are folded and fitted together, (a) said first sheet (101A) comprising (i) spaced apart side wall members (1 and 2), (ii) spaced apart partition wall members (3) having top and bottom edges extending between and at right angles to said spaced apart side wall members (1 and 2), said partition wall members being separated from each other by narrow openings (4) extending parallel to said partition wall members, (iii) a plurality of slits (5) formed in the top edge of the partition wall member (3) and equaling in number the number of the partition wall members (3) in said second sheet (101B) plus two, the outermost slits in each partition wall member (3) defining the outermost ends of that partition wall member (3), (iv) a first pair of creases (A) formed adjacent the opposite ends of each partition wall member (3) said creases (A) being parallel to said side wall members (1 and 2), and (v) a second pair of creases (B) formed in each partition wall member (3), each such crease (B) being on a 45° angle that extends between the bottom of one of said outermost slits and one end of one of said first pair of creases (A), (b) said second sheet (101B) comprising (i) spaced apart side wall members (1 and 2), (ii) spaced apart partition wall members (3) having top and bottom edges extending between and at right angles to said spaced apart side wall members (1 and 2), said partition wall members being separated from each other by narrow openings (4) extending parallel to said partition wall members, (iii) a plurality of slits (5) formed in the bottom edge of the partition wall member (3) and equaling in number the number of the partition wall members (3) in said first sheet (101A) plus two outermost slits in the top of each partition wall member (3) which define the outermost ends of that partition wall member (3), (iv) a first pair of creases (A) formed adjacent the opposite ends of each partition wall member (3) said creases (A) being parallel to said side wall members (1 and 2), and (v) a second pair of creases (B) formed in each partition wall member (3), each such crease (B) being on a 45° angle that extends between the bottom of one of said outermost slits and one end of one of said first pair of creases (A).

* * * * *